US006019241A

United States Patent [19]

Burns

[11] Patent Number: 6,019,241

[45] Date of Patent: Feb. 1, 2000

[54] PAINT TRAY WITH STORABLE CARRYING HANDLE

[76] Inventor: Kyle S. Burns, 1221 W. Turkeyfoot Lake Rd., Barberton, Ohio 44203

[21] Appl. No.: 09/002,631

[22] Filed: Jan. 5, 1998

[51] Int. Cl.[7] ..... B05C 21/00

[52] U.S. Cl. ..... 220/570; 15/257.06; 206/361; 220/761; 220/763; 220/772; 220/776

[58] Field of Search ..... 206/557, 373, 206/361; 15/257.06, 257.05; D32/53.1; 220/495.02, 696, 699, 729, 751, 752, 757, 761, 762, 763, 769, 770, 772, 775, 776, 570

[56] References Cited

U.S. PATENT DOCUMENTS

| | | | |
|---|---|---|---|
| 26,248 | 11/1859 | Brown | 220/776 X |
| 786,077 | 3/1905 | Wehmeier | 190/117 X |
| 874,681 | 12/1907 | Hungate | 215/397 X |
| 2,098,858 | 11/1937 | Busson et al. | 220/322 |
| 2,501,572 | 3/1950 | Marquez | 220/521 |
| 3,044,659 | 7/1962 | Tupper | 220/760 |
| 3,091,793 | 6/1963 | Bentley | 15/257.06 |
| 3,115,228 | 12/1963 | Louik et al. | 16/126 |
| 3,265,250 | 8/1966 | Meyer | 215/396 X |
| 3,441,172 | 4/1969 | Dike | 215/397 X |
| 3,734,336 | 5/1973 | Rankow et al. | 220/516 |
| 3,837,034 | 9/1974 | Leffert et al. | 15/257.06 |
| 5,085,386 | 2/1992 | Hicks et al. | 248/110 |
| 5,664,798 | 9/1997 | Huang | 280/642 |

FOREIGN PATENT DOCUMENTS

| | | | |
|---|---|---|---|
| 4208487 | 9/1992 | Germany | 215/399 |

*Primary Examiner*—Allan N. Shoap
*Assistant Examiner*—Joe Merek
*Attorney, Agent, or Firm*—Renner, Kenner, Greive, Bobak, Taylor & Taylor

[57] ABSTRACT

A paint tray having storable carrying handles. The paint tray is of generally standard configuration, having a ramped bottom surface leading toward a more rectangular reservoir area. The non-uniform distribution of paint in the tray typically makes it difficult to carry or maneuver. Accordingly, a pair of handles is pivotally mounted to the paint tray, one near the front end and another near the rear end of the tray. The handles may be rotated into interlocking engagement above the paint tray in a transporting position, or may be rotated and slid into engagement with respective ends of the tray in a storage position.

9 Claims, 2 Drawing Sheets

PAINT TRAY WITH STORABLE CARRYING HANDLE

TECHNICAL FIELD

The invention herein resides in the art of paint application apparatus and, more particularly, relates to apparatus for use in applying paint with a roller brush. More specifically, the invention relates to a paint tray having storable carrying handles.

BACKGROUND ART

Today, many methods exist for applying paints to large, flat surfaces such as walls and ceilings. The most common methods include brushing, rolling, or spraying paint onto the desired surface using a standard paint brush, a roller brush, or a paint sprayer.

The standard paint brush is not a popular choice for such tasks because the standard paint brush, due to its smaller width and inability to hold a large amount of paint within its bristles, does not cover a significant surface area per brush stroke and requires frequent dips into the paint in order to cover large surface areas. Consequently, painting large areas with a standard paint brush can require a great deal of time and be quite labor intensive. Furthermore, the bristles on the standard paint brush often cause the inexperienced painter to leave behind "brush marks" during application thereby leaving the surface looking rough and creating an unattractive finish. Therefore, large, flat surfaces are commonly covered using a paint sprayer or a roller brush.

The paint sprayer provides its own set of problems in that it is bulkier and more complicated to use than either the standard brush or the roller brush. Experience and care is necessary in order to evenly apply paint with a paint sprayer and to avoid spraying paint onto undesirable surfaces. Also, the weight, design and hoses associated with a paint sprayer make it considerably burdensome when having to paint elevated areas which necessitate carrying the sprayer up a ladder. Finally, the paint sprayer costs considerably more than both the standard brush and the roller brush and its purchase may not be practical for many persons undertaking a painting task. Understandably, applying paint to large, flat surface areas using a roller brush remains the most common and generally accepted method.

The roller brush is an inexpensive paint application tool that is easy to use and, due to its substantial width, provides a means to paint large surface areas in minimal time. The roller brush applies paint evenly, without brush marks, and when painting out-of-reach areas, may be carried up a ladder without difficulty. However, using a roller brush necessarily entails using a paint tray which provides difficulties of its own.

Paint trays, as commonly known in the art, are constructed having a ramped front surface, the front end of the tray being elevated and angled downwardly as the tray extends towards the rear end. This downwardly sloping ramp commonly meets a bottom or base plate anywhere from one-third to one-half of the distance to the rear end. The elevated front end is commonly supported by L-shaped legs which are also used for clipping the tray to the top rail of a step ladder or the like. This construction allows the painter to roll the roller brush down the ramp, into the paint held in the rear end and above the base plate of the tray and then roll the roller brush back up the ramp thereby allowing excess paint to drain off the roller, down the ramp, and back to the paint in the bottom. However, because the paint trays have a ramped front surface, they are not of uniform depth and the weight distribution of paint within the tray makes the tray difficult to handle and manipulate. As a result, paint is typically spilled anytime the painter seeks to move or carry a tray containing any reasonable amount of paint therein.

Therefore, there is a need in the art for a paint tray which eliminates the problem in transporting paint trays, while still providing the desired ramp design that is efficient for loading a roller brush with paint and clipping the tray to a stepladder or the like.

DISCLOSURE OF INVENTION

In light of the foregoing, it is a first aspect of the present invention to provide a paint tray which provides a ramped front to facilitate loading a roller brush with paint.

Another aspect of the invention is the provision of support legs for the ramped front end which provide support when the tray is set on a horizontal surface and provide a means for securely attaching the tray to the top of a step ladder or the like.

A further aspect of the present invention is the provision of a means for safely and easily transporting the paint tray regardless of the amount of paint contained therein and despite the lack of uniformity in depth and weight distribution inherent in the ramped design.

The foregoing and additional aspects of the present invention, which shall become apparent as the detailed description proceeds, are achieved by a paint tray construction providing a ramped front surface having support legs stabilizing the elevated front end, these support legs also providing the means by which the paint tray may be attached to the top rail of a stepladder or the like, and storable carrying handles that clip together and succeed in countering the uneven weight distribution which many times causes difficulty in transporting a paint tray. These handles securely store away by means of receiving clips and pivot from the stored position to the transporting position; therefore, the handles may be conveniently stored away while the tray is being used for its intended purpose.

BRIEF DESCRIPTION OF THE DRAWINGS

For a complete understanding of the objects, techniques, and structure of the invention, reference should be made to the following detailed description and accompanying drawings wherein.

BEST MODE FOR CARRYING OUT THE INVENTION

Figure 1:
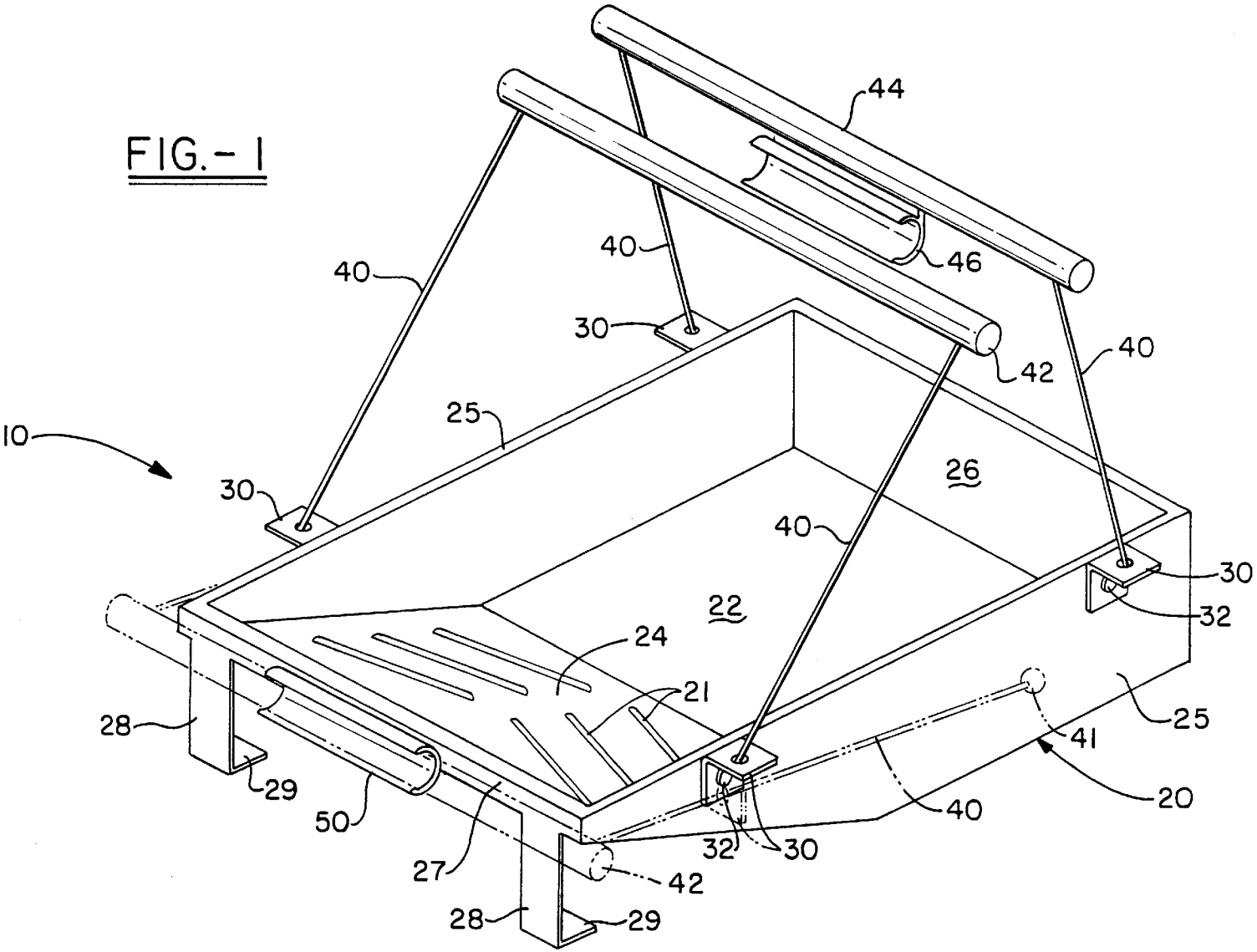
FIG. 1 is a perspective view of the paint tray according to the invention, showing the handles in a position where they could be either clipped together for safe transportation of the paint tray or, alternatively, rotated and clipped in the storage position.

Referring now to the drawings and more particularly to FIG. 1, it can be seen that the paint tray with storable carrying handles is designated generally by the numeral 10. The paint tray with storable carrying handles 10 includes a base tray 20 that is defined by a planar bottom plate 22, an angled bottom plate 24, vertical side walls 25, a vertical rear wall 26, a short front wall 27, and L-shaped support legs 28.

The support legs 28 serve to stabilize the paint tray's raised front end where the short front wall 27 and the angled bottom plate 24 meet. The legs 28 are of such a length that the feet or pads 29 extending from the bottom thereof are substantially coplanar with the bottom plate 22. This allows the paint tray 10 to be supported by a horizontal flat surface. Also, the support legs 28 provide a means for securely attaching the tray to the top of a step ladder or the like. To secure the tray, the tray is positioned so that the top step or support surface of the step ladder is located between the L-shaped legs 28 and the underside of the angled bottom plate 24, with the feet 29 engaging the underside of the top step or support surface of the step ladder. Due to its shape, the tray's center of gravity is located in the area defined above the planar bottom plate 22 and therefore the tray is held securely in place because the feet 29 of the L-shaped support legs 28, hooked underneath the top step, bear the upward force placed on them due to the fulcrum pivot point located where the top step makes contact with the angled bottom plate 24.

The angled bottom plate 24 extends downwardly from the short front wall 27 towards the planar bottom plate 22. This downward slope brings the angled bottom plate 24 into contact with the planar bottom plate 22 at a distance anywhere from about one third to about one half of the length from the front wall 27 to the vertical rear wall 26. However, it should be appreciated that the scope of the present invention is not limited by such specification.

The angled bottom plate 24 allows for easy and efficient application of paint to the roller brush. The brush is rolled down the top surface of the angled bottom plate 24 and into the paint held within the area defined by the angled bottom plate 24, the planar bottom plate 22, the vertical side walls 25, and the vertical rear wall 26. The roller brush is then slowly rolled back up the slope, thereby allowing the excess paint on the roller brush to drain off and back down the slope or ramp into the reservoir of paint. It should be appreciated that it is common practice in the art to use a paint tray liner in conjunction with the paint tray to facilitate loading paint onto the roller brush. The liner, usually constructed of a plastic material, bears the same shape as the inside of the paint tray. It is also common to provide such liner or the tray itself with ribs 21 on its angled bottom plate. These ribs 21 raise the roller brush off of the surface of the angled bottom plate 24 and provide small channels through which the excess paint on the roller brush may drain into the reservoir of paint. To expedite the drainage, the ribs commonly angle in a "V" shape downwardly and toward the center of the angled bottom plate 24. The tray liners also assist in the clean up of the trays inasmuch as they may be removed, leaving a clean tray behind.

The vertical side walls 25, vertical rear wall 26, and the short front wall 27 extend perpendicularly upwards from the bottom of the tray defined by the angled bottom plate 24 and the planar bottom plate 22, and thereby create a reservoir having a shallow front end sloping downwardly toward the rear end which is of constant depth. For painting purposes, this depth is usually not much more than a few inches.

Figure 3:
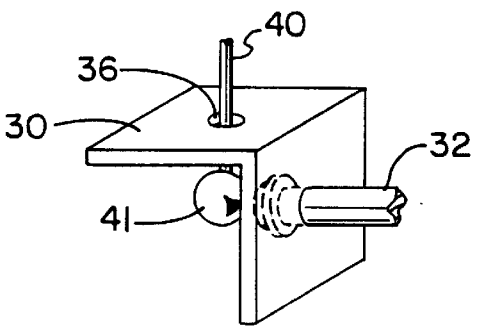
FIG. 3 is another partial sectional view of the swivel components that connect the handles to the paint tray.
Figure 2:
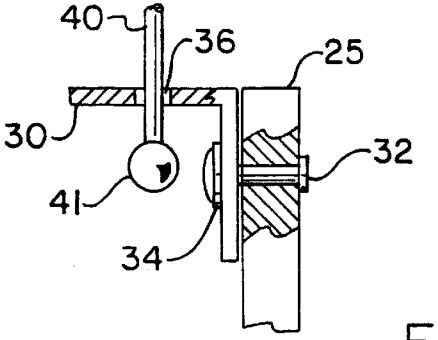
FIG. 2 is a partial sectional view of the swivel components that connect the handles to the paint tray.

In accordance with the invention, and as shown in FIG. 1, pivot brackets 30 are attached to the front and rear ends of the vertical side walls 25. Referring now to FIGS. 2 and 3, it can be seen that studs 32 extend perpendicularly outward from the vertical side walls 25 and pass through the side of each of the respective pivotal brackets 30 which is parallel to the side walls 25. Washers 34 are located between the head of the studs 32 and the pivotal brackets 30 and facilitate the rotation or pivoting of the pivotal brackets 30. Of course, the studs 32 may be of any suitable nature such as commonly known "pop rivets" or the like.

The sides of the pivotal brackets 30 that extend perpendicularly to the vertical side walls 25 contain apertures 36 through which handle stems 40 extend. The handle stems 40 are not fixedly attached to the pivotal brackets 30, but may move freely in telescoping fashion through the apertures 36. Their movement is limited only by the ball ends 41 which are of larger diameter than the apertures 36, thereby precluding removal of the stems 40 from the brackets 30.

Referring back to FIG. 1, it can be seen that the pair of handle stems 40 which extend through the pivot brackets 30 located at the front end of the paint tray are connected to the front handle 42 and, similarly, the pair which extend through the pivot brackets 30 located at the rear end of the paint tray are connected to the rear handle 44. The pivotal brackets 30 provide a means by which the front handle 42 and rear handle 44 may rotate in a circular motion, their movement being hindered only by the obstruction caused by the paint tray 20 and the handles themselves. A carrying clip 46 is attached to the rear handle 44 and, when the front handle 42 and the rear handle 44 are extended to their full length and rotated by means of the pivotal brackets 30 into the transporting position, the position where the handles meet together above the middle portion of the paint tray 20, the carrying clip 46 engages the front handle 42 and provides a single sturdy handle to increase control in transporting the paint tray. With the handles 42 and 44 in the transporting position, the paint tray may be easily carried without spilling paint despite the uneven weight distribution and awkward shape of the paint tray.

Figure 4:
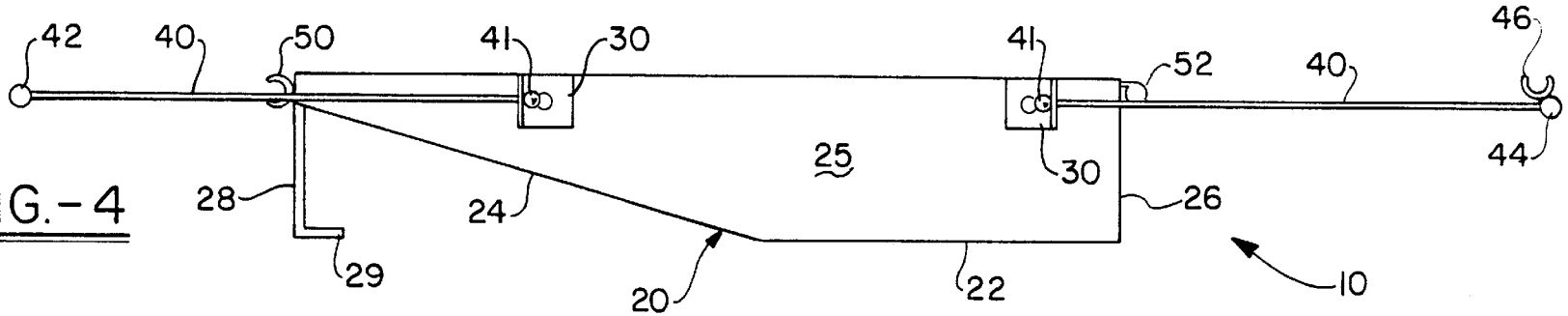
FIG. 4 is a side elevational view of the paint tray showing the carrying handles in their fully extended position wherefrom they could be either rotated to their carrying position or retracted and mounted into the stored position.
Figure 5:
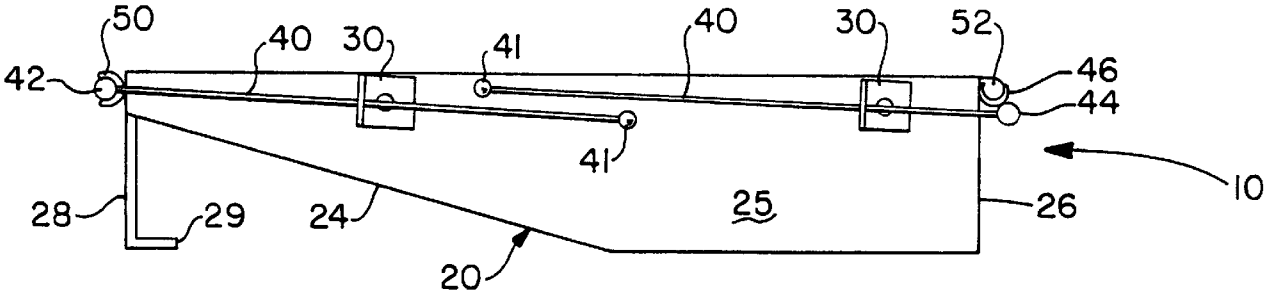
FIG. 5 is a side elevational view of the paint tray showing the carrying handles mounted in the stored position, the rear handle's clip being received by a rod mounted on the rear of the paint tray.

Referring now to FIGS. 4 and 5, it can be seen that the pivotal brackets 30 also provide a means for rotating the handles 42 and 44 into a stored position thereby placing the handles 42 and 44 out of the way while the tray is being used for its intended purpose. First, the handles 42 and 44 are rotated downwardly so that the handle stems 40 lie in substantially parallel alignment with the sides of the paint tray 20. Then, as mentioned above, the handle stems 40 are slid through the apertures 36 until the front handle 42 engages the storage clip 50 located on the outside of the short front wall 27, and the carrying clip 46 engages the storage rod 52 located on the outside of the vertical rear wall 26. Referring particularly to FIG. 3, it should be appreciated that, when in the stored position, the handle stems 40 of the front handle 42 angles slightly downwardly so as not to interfere with those of the rear handle 44. It will be appreciated that the angle of the stems 40 of the front handle 42 is determined by the relative positions of the storage clip 50 and the pivotal brackets 30 at the front end of the paint tray.

It is further contemplated that the handles 42, 44, when secured together above the tray 20 as by the clip 46, are sufficiently positioned above the tray 20 to allow access by a paint roller and/or brush. Accordingly, while storage of the handles 42, 44 prior to use may be desired, it is not necessary.

The rotation of the front handle 42 and associated pivotal brackets 30 is in the direction towards the short front wall 27. Once rotated, the rods 40 are slid through the apertures 36 until the handle 42 is received and maintained in the clip

50. Such storage is shown in phantom in FIG. 1. Similar storage is made of the handle 44.

It is also contemplated as a portion of the invention that various types of clips or other structures may be attached to opposite ends of the tray 10 to secure the handles 42, 44 for storage. The concept of the invention simply requires that the handles pivot into a first interlocking position to facilitate transport of the paint tray 10 and into a second storage position when they are retained out of the way, while the paint tray is being used. It is further contemplated, for the embodiment shown, that the rods 40 of the rear handle 44 may be bent 90° at the top so that the handle 44 could be rotatably mounted thereto, to facilitate interlocking of the clip 46 with the handle 42 or with the storage rod 52. Otherwise, simple rotation of the pivotal brackets 30 achieve such selected engagement.

It should now be appreciated that the objects of the invention have been satisfied by the structure presented above. The sloping bottom plate of the paint tray allows for easy application of the paint onto the roller brush. L-shaped support legs provide a means for safely securing the paint tray to the top of a step ladder or similar structure when one must paint elevated areas where repeated trips to a paint tray setting on the floor would be time consuming and burdensome. The carrying handles provide a practical means for transporting the paint tray regardless of the amount of paint contained therein and the lack of uniform weight distribution inherent in the paint tray's design. Furthermore, the carrying handles quickly and conveniently store away while the tray is being used for its intended purposes.

While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A paint tray with carrying handles, comprising:

a rectangular bottom plate;

a ramped end plate extending upwardly from said rectangular bottom plate;

walls extending vertically upward from borders of an area defined by said rectangular bottom plate and said ramped end plate;

L-shaped support legs extending downwardly from said ramped end plate to a plane defined by said rectangular bottom plate and then extending inwardly toward said rectangular bottom plate;

a rear end handle having arms pivotally connected to each side near a rear end of the paint tray;

a front end handle having arms pivotally connected to each side near a front end of the paint tray; and brackets that connect said rear end handle and said front end handle to the paint tray said brackets pivotally connected to said paint tray and allowing said handles to rotate between a transporting position and a storage position wherein said brackets are characterized by apertures which slidingly receive said arms of said front end and said rear end handles, thereby allowing the handles to retract and extend along the length of their handle arms.

2. The paint tray according to claim 1, further comprising a clip attached to one of said handles and wherein said clip receives and securely attaches said front end handle and said rear end handle together when in said transporting position.

3. The paint tray according to claim 2, further comprising a storage clip on one of said walls of the paint tray for receiving one of said handles when said one of said handles is rotated downwardly and retracted.

4. The paint tray according to claim 3, further comprising a receiving rod on one of said walls of the paint tray for receiving the clip attached to the other of said handles when said other of said handles is rotated downwardly and retracted to said storage position.

5. The paint tray according to claim 4, wherein said arms of said retracted front end handle angle slightly downwardly so as not to interfere with said arms of said retracted rear end handle when said front and rear end handles are in said second storage position.

6. A paint tray, comprising:

an elongated container having a base;

a pair of side walls extending upwardly from said base;

a pair of end walls interconnecting said side walls and extending upwardly from said base;

a front handle pivotally connected to said pair of side walls near a first of said end walls;

a rear handle pivotally connected to said pair of side walls near a second of said end walls;

a first clip carried by one of said handles, said first clip securing said front and rear handles together when said handles are pivoted to a transporting position; and a second clip on one of said end walls and a rod on the other of said end walls, wherein said first clip carried by said one of said handles engages said rod, and said second clip engages said other handle when said handles are in said storage position.

7. The paint tray according to claim 6, wherein said end walls have retainers, said retainers receiving and maintaining said handles when said handles are rotated to a storage position.

8. The paint tray according to claim 6, wherein said first clip carried by said one of said handles engages said rod, and said second clip engages said other handle when said handles are in said storage position.

9. The paint tray according to claim 6, further comprising pivotal brackets mounted to said side walls and receiving said handles.

* * * * *